US005225846A

United States Patent [19]

Koyama

[11] Patent Number: 5,225,846

[45] Date of Patent: * Jul. 6, 1993

[54] WRIST CARRIED WIRELESS INSTRUMENT

[75] Inventor: Shunsuke Koyama, Suwa, Japan

[73] Assignee: Seiko Epson Corporation, Tokyo, Japan

[ * ] Notice: The portion of the term of this patent subsequent to Dec. 17, 2008 has been disclaimed.

[21] Appl. No.: 714,968

[22] Filed: Jun. 13, 1991

Related U.S. Application Data

[62] Division of Ser. No. 326,346, Mar. 21, 1989, Pat. No. 5,072,231.

[30] Foreign Application Priority Data

Mar. 23, 1988 [JP] Japan ..... 63-68455
Nov. 15, 1988 [JP] Japan ..... 63-287937

[51] Int. Cl.[5] ..... H01Q 7/00
[52] U.S. Cl. ..... 343/718; 343/744
[58] Field of Search ..... 343/718, 744; 455/351

[56] References Cited

U.S. PATENT DOCUMENTS 3,032,651 5/1962 Gisiger-Stahli et al. ..... 343/718
4,713,808 12/1987 Gaskill et al. ..... 343/718
4,714,887 12/1987 Meissner et al. ..... 324/322
4,769,656 9/1988 Dickey ..... 343/718
4,817,196 3/1989 MacNak et al. ..... 455/193
4,922,260 5/1990 Gaskill et al. ..... 343/718
5,072,231 12/1991 Koyama ..... 343/718

FOREIGN PATENT DOCUMENTS 973146 12/1959 Fed. Rep. of Germany ..... 343/744
3209345 9/1983 Fed. Rep. of Germany .
88000257 3/1988 Fed. Rep. of Germany .
2201266 12/1986 United Kingdom .

OTHER PUBLICATIONS

Saito and Naito, *ON Ferite Bar Antenna And Its Gain Limitation.*

Ito, Haruki, Fujimoto, *A Small Loop Antenna For Pocket Size VHF Radio Equipment, Natl. - Technical Report,* vol. 19 Apr. 1973.

*Primary Examiner*—Michael C. Wimer
*Attorney, Agent, or Firm*—Blum Kaplan

[57] ABSTRACT

A wrist carried wireless instrument for minimizing the effects of coming in contact with the wrist of the user is provided. A case contains wireless instrument circuitry. A loop antenna extends without the case. An antenna resonance circuit has two capacitors connected in series. The two capacitors are connected to the loop antenna. A connection between two of the capacitors is formed at substantially the half impedance value across the capacitors and is a ground electric potential. An RF amplifier connects the loop antenna to the wireless instrument circuitry.

7 Claims, 4 Drawing Sheets

FIG. 3a
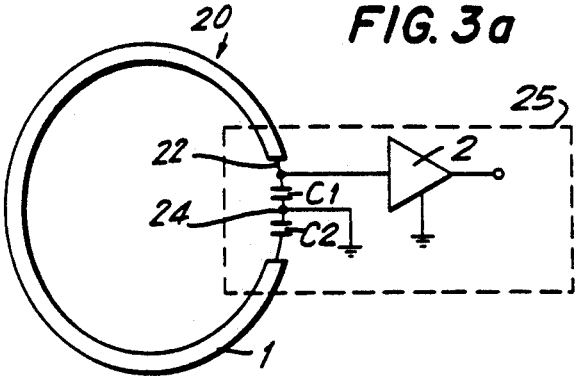
FIG. 4b
PRIOR ART
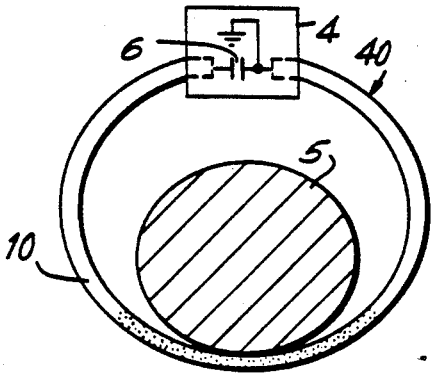
FIG. 3b
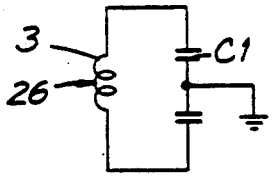
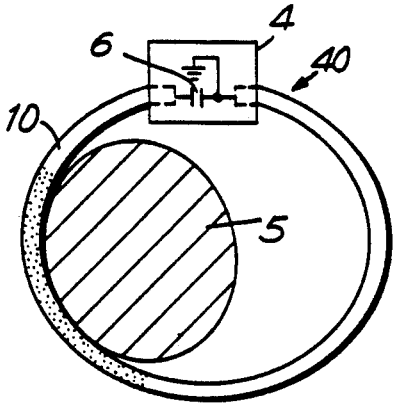
FIG. 4c
PRIOR ART
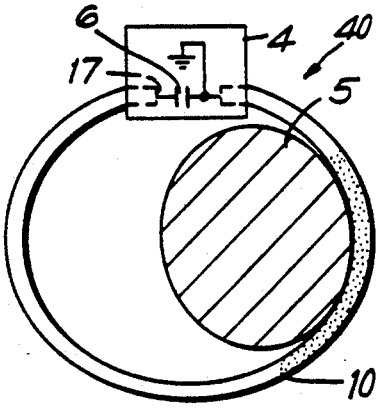
FIG. 4a
PRIOR ART FIG. 5a
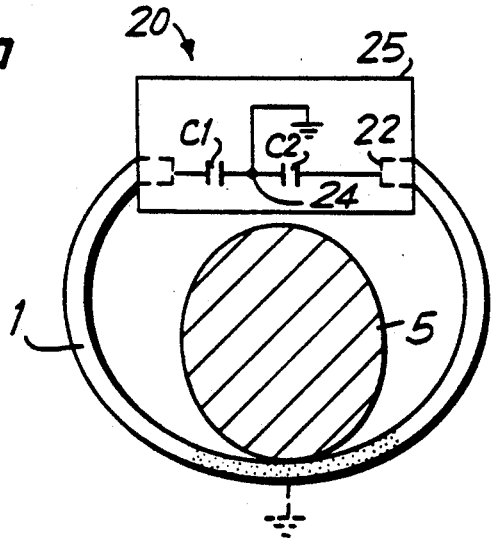
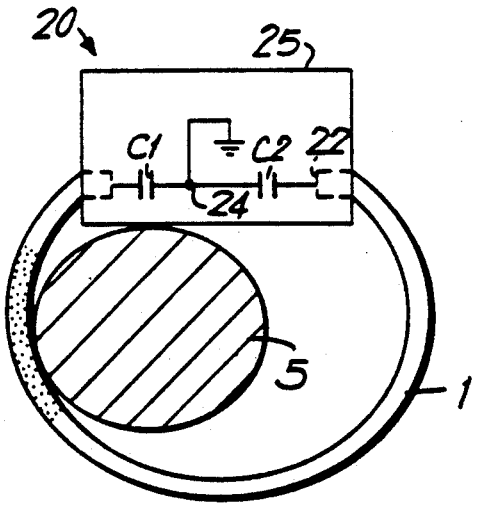
FIG. 5b
FIG. 6
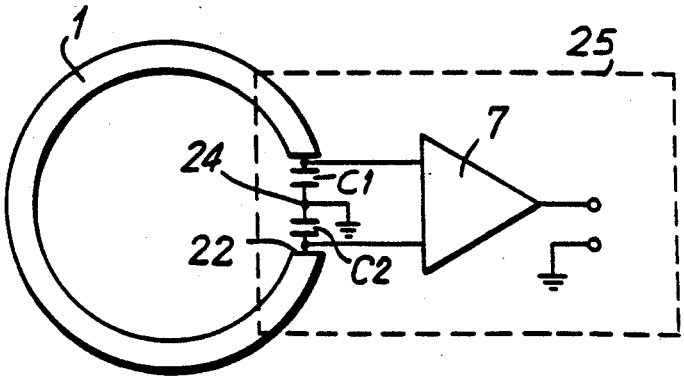

FIG. 7
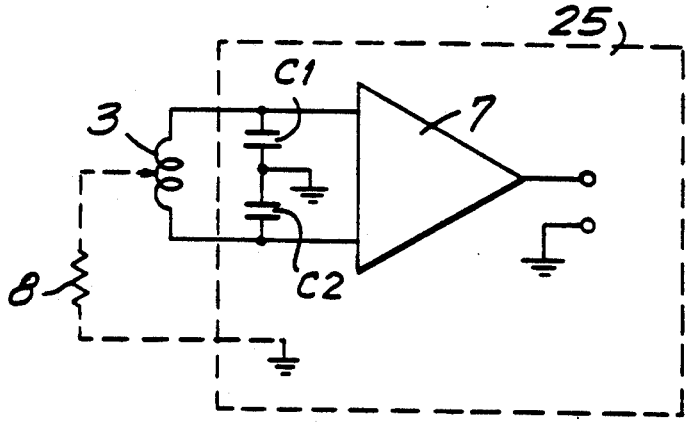
FIG. 8
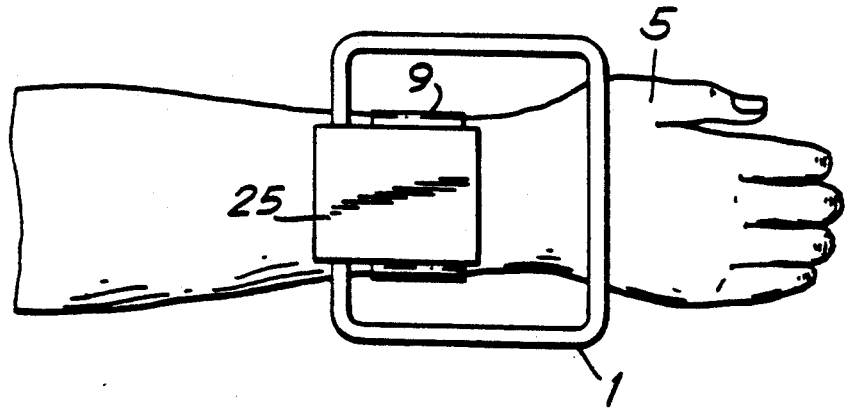
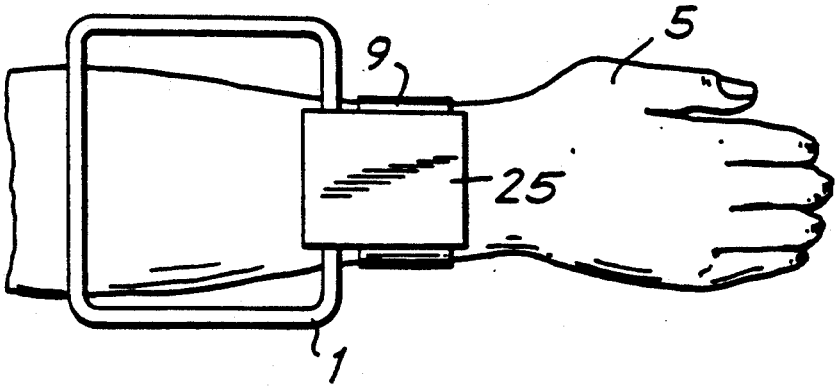
FIG. 9

WRIST CARRIED WIRELESS INSTRUMENT

This is a division of U.S. patent application Ser. No. 07/326,346 filed on Mar. 21, 1989 which issued as U.S. Pat. No. 5,072,231 on Dec. 20, 1991.

BACKGROUND OF THE INVENTION

The present invention relates to a wrist carried wireless instrument, and in particular, to an improved antenna resonance circuit for a wrist carried wireless instrument.

Wrist carried wireless instruments are known in the art as exemplified by wrist mounted AM radios, FM radios, FM transceivers and miniature pocket pagers. Each device uses a distinct form of antenna. The miniature AM radios utilize a ferrite antenna stored in the case. The FM radios utilize a wireless antenna which is connected to the case and also serves as an earphone to receive signals. FM transceivers use a rod antenna which is drawn from the wrist carried case to be used during transmission. The pocket pager utilizes a small sized loop antenna having an area of several centimeters square to about 10 centimeters square. The resonance frequency of the antenna may be varied by varying the capacitance.

The above antennas have been satisfactory. However, if the ferrite antenna of the AM radio is to be used in connection with a high frequency such as a VHF band, it becomes necessary to provide a large sized ferrite antenna making it extremely difficult to carry the radio and the antenna on the wrist. Therefore, the use of a ferrite antenna is limited to the traditional AM radio frequencies.

The rod antenna of the FM transceiver and the antenna of the FM radio are also carried on the wrist therefore making it an obstacle to normal activities due to large size of each antenna. Additionally, if the antenna is to be stored within the device and removed as needed, it becomes difficult to continuously place the antennas in either the receiving or transmitting condition as necessary due to the large size.

The receiving sensitivity of the pocket pager becomes inferior as the loop area of the loop antenna decreases. Accordingly, when the loop antenna is actually small enough to be placed within the case of a wrist carried pocket pager, the sensitivity becomes extremely inferior for the purpose of receiving the relatively large VHF long waveform. Therefore, when the pocket pager is formed as a wrist carried device, the loop antenna is formed outside of the case. To obtain good sensitivity it becomes necessary to have as large a loop area as possible while maintaining a shape which is convenient and fits about the wrist.

For example, a wrist carried loop may fit about the wrist as shown in FIG. 1*a*, 2*a* or a loop having a case surrounding shape shown in FIG. 8 may be used. As seen in FIG. 1*a*, a wireless instrument generally indicated at 30 includes a case for having a loop antenna 10 extending therefrom. Loop antenna 10 includes an opening 17 within the loop. A capacitor $C_3$ is provided across loop opening 17. An RF amplifier 12 is connected to loop opening 17 between capacitor $C_3$ and one end of loop antenna 10. RF amplifier 12 connects loop antenna 20 to the remainder of the wireless instrument circuitry contained within case 4. Capacitor $C_3$ is grounded at its other end.

A wireless instrument 35 constructed in accordance with the prior art as shown in FIG. 2*a* also contains a resonance circuit. The resonance circuit of instrument 35 is similar to that of instrument 30. However, two capacitors $C_4$ and $C_5$ are provided in series across loop antenna opening 17. Capacitors $C_4$ and $C_5$ are connected at a terminal 27. RF amplifier 12 connects to the resonating circuit at terminal 27.

These wrist carried wireless instruments having an antenna resonance circuit as shown have been less than satisfactory. They suffer from the disadvantage that if the antenna is brought in contact with the wrist, the wrist provides a load relative to the resonance circuit of the loop antenna. This greatly reduces the quality of the resonance circuit as well as the sensitivity of the instrument making the wrist carried wireless instrument unsuitable for practical use. When the loop antenna does not surround the wrist, but surrounds the case as shown in FIGS. 8 and 9, the circuit quality becomes reduced as the loop antenna approaches or contacts the wrist thereby deteriorating sensitivity.

Accordingly, it is desired to provide a wrist carried wireless instrument which overcomes the above shortcomings and provides a wrist carried wireless instrument which prevents deterioration of quality due to contact with the wrist while providing good sensitivity to receive the signals.

SUMMARY OF THE INVENTION

A wrist carried wireless instrument includes a loop antenna. A resonance circuit matches the inductance of the loop antenna with at least two capacitors. A ground is provided between the two capacitors causing the contact between the antenna and the wrist to provide a load relative to only a portion of the antenna preventing deterioration of quality or the receiving of signals by the other portion of the antenna.

Accordingly, it is an object of the invention to provide an improved wrist carried wireless instrument.

Another object of the present invention is to provide a wrist carried wireless instrument in which the quality of operation does not deteriorate when the instrument comes in contact with the wrist of the user.

A further object of the invention is to provide a wrist carried wireless instrument of simple construction which reduces the effect of contact with the wrist and other persons.

Yet another object of the present invention is to provide a wrist carried wireless instrument of high sensitivity.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3*a* is a schematic and circuit diagram of a wireless instrument constructed in accordance with the invention;

FIG. 3*b* is a circuit diagram of an equivalent circuit for the instrument of FIG. 3*a;*

FIGS. 4*a*–4*c* are schematic and circuit diagrams of the wireless instrument of the prior art oriented relative to the wrist of the user;

FIGS. 5*a* and 5*b* are schematic and circuit diagrams of a wireless instrument constructed in accordance with the invention oriented relative to the wrist of the user;

FIG. 6 is a schematic and circuit diagram of a wrist carried wireless instrument constructed in accordance with another embodiment of the invention;

FIG. 7 is a circuit diagram of the equivalent circuit of the wireless instrument of FIG. 6;

FIG. 8 is another embodiment of a wrist carried wireless instrument constructed in accordance with the invention; and FIG. 9 is another embodiment of a wrist carried wireless instrument constructed in accordance with the invention.

DETAILED DESCRIPTION OF THE PREFERRED EMBODIMENT

Figure 1A:
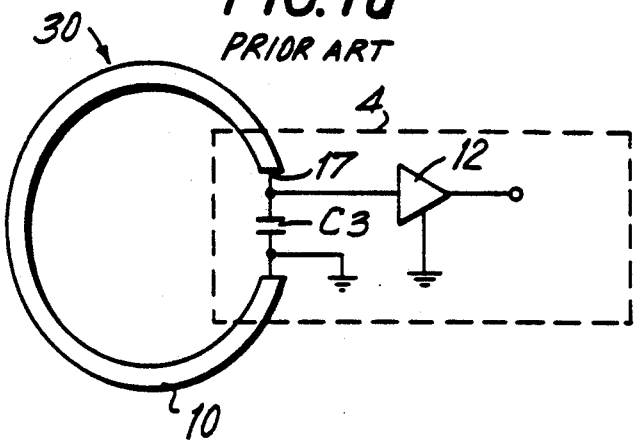
FIG. 1a PRIOR ART
FIG. 1*a* is a schematic and circuit diagram of a wrist carried wireless instrument constructed in accordance with the prior art.

Reference is first made to FIGS. 3*a*, 3*b* in which the antenna circuit of a wrist carried wireless instrument generally indicated at 20, constructed in accordance with a first embodiment of the invention is provided. A case 25 shown in dotted lines contains the circuitry for wireless instrument 20. A loop antenna extending from case 25 is formed in a loop shape. Loop antenna 1 surrounds the wrist in a manner similar to a wristwatch band when wireless instrument 25 is being carried.

An antenna resonance circuit is formed by a capacitor pair (defining a first capacitor means and) including a first capacitor $C_1$ (or second capacitor means) and a second capacitor $C_2$ (or third capacitor means) placed in series across an opening 22 of loop antenna 1. Capacitors $C_1$ and $C_2$ have a substantially equal capacitance. The connection 24 between capacitors $C_1$ and $C_2$ is coupled to a resonance circuit ground. Accordingly, the circuit is grounded at substantially the half impedance portion of the impedance circuit formed in wireless instrument 20.

An RF amplifier 2 for connecting loop antenna 1 with the wireless instrument circuitry is connected to loop antenna 1 between one end point of loop antenna 1 within opening 22 and either of capacitor $C_1$ and $C_2$. RF amplifier 2 is also connected to a reference ground and the remainder of the circuitry of wireless instrument 20 contained within case 25. To simplify the circuitry, additional capacitors for connecting the resonance circuit to RF amplifier 2 are omitted.

An equivalent circuit of the antenna resonance circuit of the wireless instrument 20 is provided in FIG. 3*b*. Coil 3 represents the equivalent inductance provided by loop antenna 1. Because the connection 24 between capacitors $C_1$ and $C_2$ is grounded, intermediate position 26 along equivalent inductance coil 3 has an electric potential equal to capacitors $C_1$ and $C_2$; substantially the same potential as at the electric ground potential.

Figure 1B:
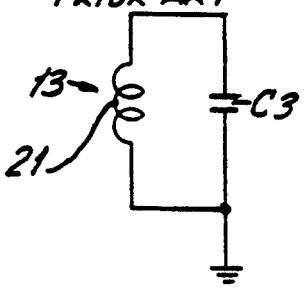
FIG. 1b PRIOR ART
FIG. 1*b* is a circuit diagram of the equivalent circuit of the wireless instrument of FIG. 1*a;*

To better understand the operation of wireless instrument 20, reference is again made to prior art instrument 30 of FIGS. 1*a*, 1*b*. As discussed above, the prior art wireless instrument includes a loop antenna 10 having an opening 17 within the loop. A capacitor $C_3$ is provided across loop opening 17. An RF amplifier 12 is connected to loop antenna opening 17 between capacitor $C_3$ and one end of loop antenna 10. Capacitor $C_3$ is grounded at its other end. Accordingly, one end of loop antenna 10 is grounded forming a resonance circuit between the grounded end of loop antenna 10 and the hot side of resonance capacitor $C_3$ which is connected to RF amplifier 2.

Accordingly, as illustrated by the equivalent circuit of FIG. 1*b*, the impedance equivalent coil 13 has a higher electric potential at an intermediate portion 21 than the ground electric potential.

Figure 2A:
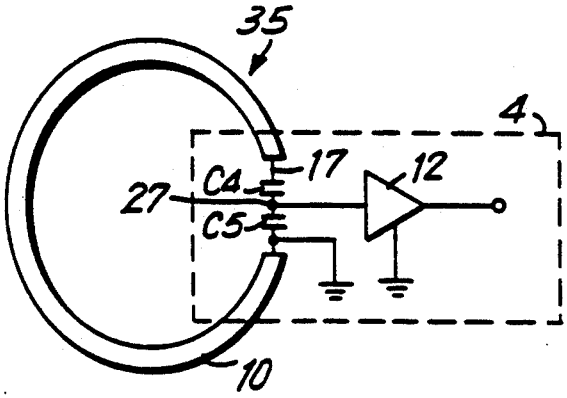
FIG. 2a PRIOR ART
FIG. 2*a* is a schematic and circuit diagram of a wrist carried wireless instrument constructed in accordance with the prior art.
Figure 2B:
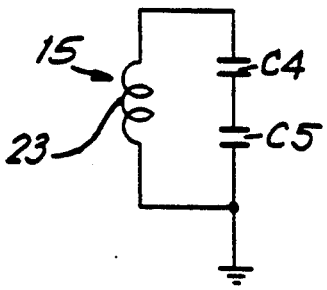
FIG. 2b PRIOR ART
FIG. 2*b* is a circuit diagram of the equivalent circuit of the wireless instrument of FIG. 2*a;*

Reference is now made FIG. 2*a* in which prior art instrument 35 having two capacitors $C_4$ and $C_5$ to reduce the impedance at the ground is shown. RF amplifier 12 connects to loop antenna 10 at a terminal 27 intermediate capacitors $C_4$ and $C_5$. Loop antenna 10 is still grounded at one end of opening 17 adjacent a single capacitor; in this example $C_5$. Accordingly, when the impedance at RF amplifier 12 is low, the impedance at terminal 27, the connection between capacitors $C_4$ and $C_5$ matches the impedance of RF amplifier 12. As illustrated in the equivalent circuit of FIG. 2*b* the equivalent inductance coil 15 of loop antenna 10 again has a higher electric potential at an intermediate point 23 along coil 15 than the ground electric potential.

Reference is made to FIGS. 4*a*–4*c* in which the operational differences between the prior art having the ground located at one end of loop antenna 10 and wireless instrument 20 which is grounded at a terminal between the capacitor pair is demonstrated. A wireless instrument, generally indicated at 40 has a construction similar to that of prior art wireless instrument 30 and includes a loop antenna 10 which fits about a wrist 5 (shown in cross-section). Each end of loop antenna 10 is partially contained within case 4. A resonance capacitor 6 is provided across opening 17 between ends of loop antenna 10. Again, a ground is provided at one end of capacitor 6.

Generally, resonance circuits having the prior art construction as shown in FIGS. 4*a*–4*c* are greatly affected by the relative positioning of wrist 5 and loop antenna 1. When the wrist contacts loop 10, the wrist acts as a ground to the circuit and as a load between the antenna and the circuit ground so that the antenna operation is affected by contact with the human body. Accordingly, as shown in FIG. 4(*a*) when wrist 5 contacts loop 10 as indicated by the shaded region of loop 10, the contact is close to the ground terminal of loop antenna 10 therefore the quality, Q, of the antenna resonance circuit is negligibly reduced and the circuit sensitivity is not greatly affected. However, in FIG. 4(*b*) the contact portion between wrist 5 and loop antenna 10 is at an intermediate portion of loop antenna 10 as shown in the shaded region so that the ground affect of wrist 5 becomes greater reducing the quality, Q, of the antenna resonance circuit. Additionally, as shown in FIG. 4*c*, when wrist 5 contacts loop 10 at a side having a higher electric potential than the ground, wrist 5 acts as a load for antenna 10 and the quality, Q, of the resonance circuit is reduced to a point that makes instrument 40 impractical for use. Therefore, when the prior art resonance circuit is utilized, receiving sensitivity changes with the carrying condition of the receiver. At its worst, the antenna resonance circuit cannot be applied to practical use.

Reference is now made to FIGS. 5*a* and 5*b* wherein the operation of wireless instrument 20, constructed in accordance with the invention is provided. As shown in FIG. 5*a* wrist 5 contacts antenna loop 1 at an intermediate position. Because the ground for wireless instrument 20 is provided between capacitors $C_1$ and $C_2$, whichever of the capacitors $C_1$ and $C_2$ perceives wrist 5 as ground will be affected, but the other capacitor will not perceive wrist 5 as a ground or a load and therefore operate in conjunction with loop antenna 1. Accordingly, in the intermediate position the quality, Q of the resonance circuit is not greatly reduced. Additionally, when wireless instrument 20 is carried on wrist 5, it is mostly likely carried in the position in which wrist 5 contacts the center portion of loop antenna 1 as shown by the shaded region of FIG. 5(*a*). Therefore, if loop antenna 1 is used in accordance with the invention, sensitivity deterioration is almost never generated.

As seen in FIG. 5*b*, loop 1 contacts wrist 5 at a side as indicated in the shaded portion. The hot side of the resonance circuit is most likely affected by the load applied by wrist 5. However, as discussed above the other side of loop antenna 1 operates effectively so that the resonance circuit quality, Q, is hardly reduced making wireless instrument 20 extremely practical.

It should be noted that even if loop antenna 1 or loop antenna 10 is insulated by an outer cover, the quality of the resonance circuit is reduced as described above. Additionally, if as in FIGS. 8 and 9, case 25 is supported upon a wrist belt 9 and loop antenna 1 extends from case 1, i.e. antenna 1 does not completely surround wrist 5, the resonance circuit operates in the same manner as when loop antenna 1 contacts the wrist or any portion of the user's body. The body will still act as a load, deteriorating quality except for the instance in which a ground is provided between capacitors $C_1$ and $C_2$.

Reference is now made to FIG. 6 in which another embodiment of a wireless instrument constructed in accordance with the invention is provided. Like structures are identified by like numbers, the substantial difference in this embodiment being that the capacitor pair is connected across a front end RF amplifier.

Loop antenna 1 is formed with an opening 22. An RF amplifier is connected across opening 22 of loop antenna 1. Capacitors $C_1$ and $C_2$ are connected in series and across RF amplifier 7. A ground is provided at a connection terminal 24 between capacitors $C_1$ and $C_2$.

Antenna loop 1 has an induced voltage drawn at both ends of loop antenna 1. The drawn voltage is input at the respective loop antenna terminals. The intermediate potential of the impedance obtained by resonance capacitors $C_1$ and $C_2$ goes to the ground electric potential. Accordingly, loop antenna 1 may be regarded as a power source of a balanced output signal relative to front end RF amplifier 7. Therefore, in this embodiment, the input circuiyt for the wireless instrument is formed by loop antenna 1 acting as a power source of the balanced output signal and an amplifying circuit having an equivalent input terminal.

Reference is now made to FIG. 7 which depicts an equivalent circuit for the wireless instrument in which the RF amplifier is equivalently driven. Inductance coil 3 represents the equivalent inductance provided by loop antenna 1. The equivalent load resistance generated by a human body contacting loop antenna 1 is represented by resistor 8 which acts as the circuit ground. Accordingly, the equivalent load resistor is positioned between the circuit ground and the equivalent inductance represented by balance inductance coil 3. The largest contact portion between the human body and the circuit is the circuit ground, therefore, the human contact on loop antenna 1 can be regarded as a load between the antenna and the ground. It follows, as discussed above, that the operation of loop antenna 1 is affected by the human body when the human body approaches any part of the antenna or when loop antenna 1 is carried on the wrist.

When the wireless instrument is carried on the wrist, it is advantageous to operate loop antenna 1 and the inputs of RF amplifying circuit 7 as an equivalent relative to the antenna coming in contact with the human body so that the signal current flowing to the antenna and the amplifying circuit do not flow to equivalent load resistor 8 due to loop antenna 1 contacting the human body. It would seem difficult to indicate the entire human body load by a single equivalent resistor 8, but such load can be regarded as the main load of the human body. The portion of loop antenna 1 which is brought in contact with the wrist has a substantially ground electric potential, so the effects of the antenna coming in contact with the human body reduced.

Additionally, it is possible to reduce a load provided on the antenna by the nearness of the antenna to the human body by equivalently driving the antenna and RF amplifier 7.

FIGS. 5 and 6 show one embodiment of the present invention wherein the intermediate electric potential of the resonance capacitors $C_1$ and $C_2$ is equal to the ground electric potential. However, since the antenna and the RF amplifier are equivalent circuits, even if the intermediate electric potential is not ground electric potential, the loop antenna is not likely to be affected by the entire human body load as shown in FIG. 6. Therefore, if the intermediate electric potential of the resonance capacitors $C_1$ and $C_2$ is not equal to the ground electric potential, it is also possible to provide a wrist carried wireless instrument which prevents deterioration of quality.

As discussed above, in the prior art wrist carried wireless instsruments, the effect of the load provided by the wrist of the wearer changes in accordance with the electric potential of the intermediate portion of the loop antenna at the intermediate portion in which it contacts the wrist. The degree of effect varies depending upon whether the contact of the intermediate portion of the loop antenna occurs at a high potential or a low potential. When the electric potential of the intermediate portion contacting the wrist is high, the quality of the antenna resonance circuit is greatly reduced. This reduction in quality, Q, is caused by reduction of the antenna gain which also may reduce the overall sensitivity of the wireless instrument.

By providing a wrist carried wireless instrument wherein the electric potential of the portion connected to the wrist is equal to the ground, a resonance circuit is not greatly affected by coming in contact with the wrist. Additionally, even if the antenna resonance circuit is attached to the wrist or brought in contact with another wrist or another human body, the antenna resonance circuit is again not affected.

Generally, the gain of resonance small loop antennas used in pocket pagers or the like is approximately −30 dB of half waveform dipole ratio. If the wrist carried loop antenna is formed outside of the case, the open area of the antenna is larger than that of the pocket pager with the in case antenna. Therefore, when the wrist carried device is not carried on the wrist, a circuit having excellent sensitivity may be obtained. However, where the electric potential of one end of the loop antenna is a ground electric potential, when the wireless instrument is carried on the wrist, there is possibility that the antenna gain might be reduced by at least 10dB and there is possibility that the output impedance of the antenna resonance circuit may be greatly reduced. It becomes difficult to match the antenna resonance circuit with the RF amplifier. Additionally, the deterioration properties are likely to be generated when other human body parts other than the wrist carrying the device or other humans generally approach the antenna or circuit.

However, by additionally providing an RF amplifier connected across a gap of the loop antenna and having the capacitors connected across the input terminals of the amplifier, the wrist carried wireless instrument may be driven equivalently in a simple circuit construction. This makes it possible to reduce the deterioration of properties which are caused by the antenna coming in close proximity with body parts other than the wrist and with other humans.

For the reasons discussed above, it is impossible for the prior art wireless instrument to obtain a gain adaptable to practical use, such as approximately −30dB, while providing an antenna having a convenient shape. Thereby, it is difficult to provide a wrist carried wireless instrument suitable for practical use. However, by providing a wireless instrument having a capacitor pair provided across the gap of a loop antenna and a voltage ground potential at the connection between the capacitor pair, it is possible to greatly reduce the effect of a wrist coming in contact with the loop antenna utilizing a simple circuit construction. It also becomes possible to provide a construction for reducing the effect of other humans and other body parts coming in contact with the loop antenna resulting in a wireless instrument which operates at an antenna gain making use practical resulting in a highly sensitive wrist carried wireless instrument.

It will thus be seen that the objects set forth above, among those made apparent from the preceding description, are efficiently attained and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language might be said to fall therebetween.

What is claimed is:

1. A wrist carried wireless instrument comprising a case for supporting wireless instrument circuitry, a loop antenna extending from said case, an antenna resonance circuit formed by said loop antenna and a first capacitor means for providing capacitance coupled in series, said series coupled first capacitor means being coupled with said loop antenna, an electric ground potential coupled intermediate said series coupled first capacitor means dividing said first capacitor means into a a second capacitor means for providing capacitance and a third capacitor means for providing capacitance and coupling means for coupling said loop antenna to said wireless instrument circuity, said second capacitor means having a capacitance substantially equal to the capacitance of said third capacitor means, said antenna resonance circuit providing a balanced output to said wireless instrument circuitry.

2. The wrist carried wireless instrument of claim 1, wherein said loop antenna has a first end and a second end, further comprising an RF amplifier and wherein said coupling means couples said RF amplifier to said antenna resonance circuit between said first end of said loop antenna and an end of said second capacitor means not coupled to said electric ground potential, and between said second end of said loop antenna and an end of said third capacitor means not coupled to said electric ground potential, the first capacitor means providing a balanced input to said RF amplifier.

3. The wrist carried wireless instrument of claim 1, wherein said loop antenna is formed to extend about a wrist of a user.

4. The wrist carried wireless instrument of claim 2, wherein said loop antenna is formed to extend about a wrist of a user.

5. The wrist carried wireless instrument of claim 1, wherein the wireless circuitry includes an RF amplifier and said coupling means couples said RF amplifier to said loop antenna.

6. The wrist carried wireless instrument of claim 5, wherein said loop antenna is formed to extend about a wrist of a user.

7. A wrist carried wireless instrument comprising a case for supporting wireless instrument circuitry, a loop antenna, first capacitor means coupled in series with said loop antenna for providing capacitance at said loop antenna, said antenna and said first capacitor means forming an antenna resonance circuit, an electric ground potential coupled intermediate to said series coupled first capacitor means dividing said first capacitor means into a second capacitor means for providing capacitance and a third capacitor means for providing capacitance, a case, and an RF amplifier directly coupled to said loop antenna and said first capacitor means within said case, said second capacitor means having a capacitance substantially equal to the capacitance of said third capacitor means.

* * * * *